US005224718A

United States Patent [19]

Gertler

[11] Patent Number: 5,224,718

[45] Date of Patent: Jul. 6, 1993

[54] FOOT TRANSPORT DEVICE

[76] Inventor: Robert Gertler, 23-10A Cpl. Kennedy Ave., Bayside, N.Y. 11360

[21] Appl. No.: 787,019

[22] Filed: Nov. 4, 1991

[30] Foreign Application Priority Data

Nov. 28, 1990 [GB] United Kingdom ..... 9025843

[51] Int. Cl.[5] ..... A63C 17/04

[52] U.S. Cl. ..... 280/11.19; 280/11.2; 280/11.22; 280/11.26; 280/11.27

[58] Field of Search ..... 280/11.19, 11.22, 11.26, 280/11.27, 11.28, 11.12, 8, 10

[56] References Cited

U.S. PATENT DOCUMENTS

| | | | |
|---|---|---|---|
| 301,676 | 7/1884 | Clark | 280/11.23 |
| 954,993 | 4/1910 | Peters | 280/11.22 |
| 1,981,211 | 11/1934 | Zareko | 280/11.26 |
| 2,190,316 | 2/1940 | Harris | 280/11.26 |
| 2,245,769 | 1/1941 | Flam | 280/11.26 |
| 2,764,417 | 9/1956 | Sweet | 280/11.12 |
| 3,823,952 | 7/1974 | Kakalowicz | 280/11.2 |
| 4,273,345 | 6/1981 | Ben-Dor | 280/11.22 |
| 4,896,893 | 1/1990 | Shumays et al. | 280/14.2 |
| 4,966,377 | 10/1990 | Yu | 280/11.2 |

FOREIGN PATENT DOCUMENTS

| | | |
|---|---|---|
| 0043250 | 1/1982 | European Pat. Off. . |
| 421314 | 1/1925 | Fed. Rep. of Germany . |
| 2077698 | 11/1971 | France . |
| 2560779 | 9/1985 | France . |

*Primary Examiner*—Richard M. Camby
*Attorney, Agent, or Firm*—Jay L. Chaskin

[57] ABSTRACT

A foot transport device for fastening to a foot, in particular, a roller skate. The device has a sole portion 2 to which is affixed a plurality of wheels 22, 54 arranged successively in tandem along the longitudinal length of the sole portion. A removable stabilizer is arranged on either side of the sole portion to allow the unskilled to learn to use the device. The stabilizer protrudes laterally outwardly of the wheels. The stabilizer may comprise wheels 50 or an outrigger blade 62.

8 Claims, 6 Drawing Sheets

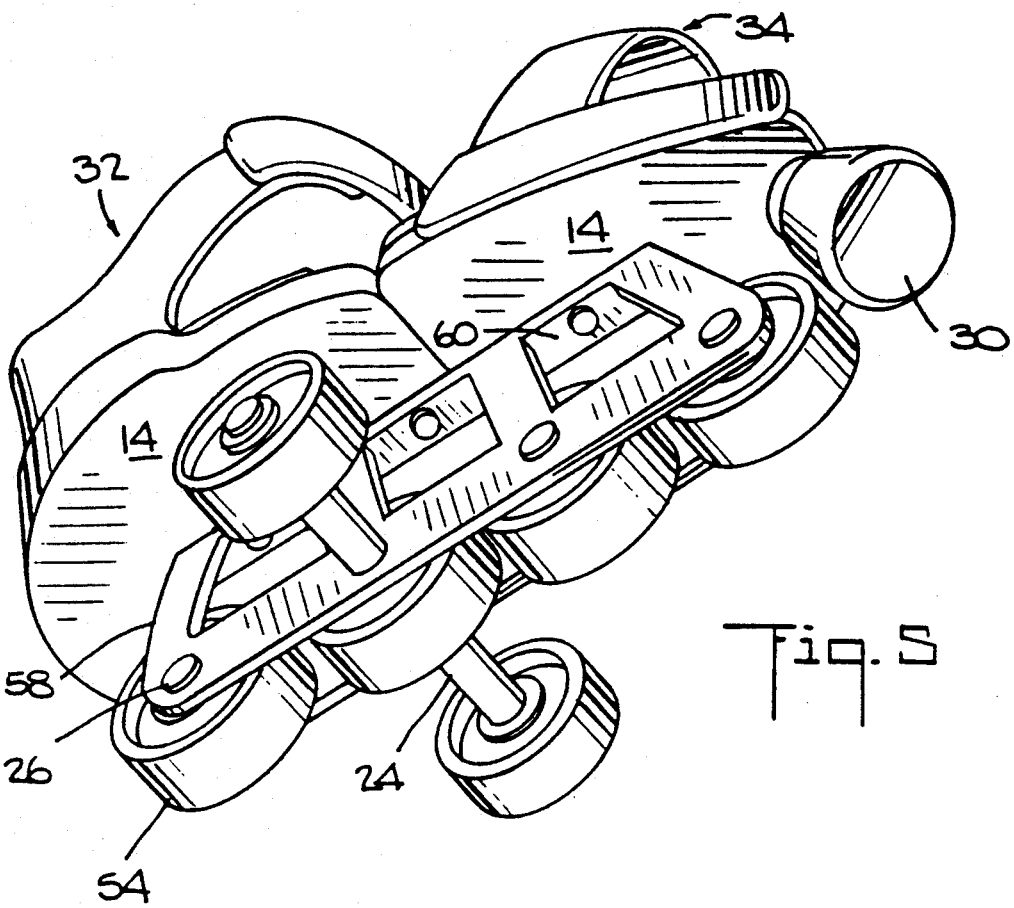
Fig. 5
Fig. 6
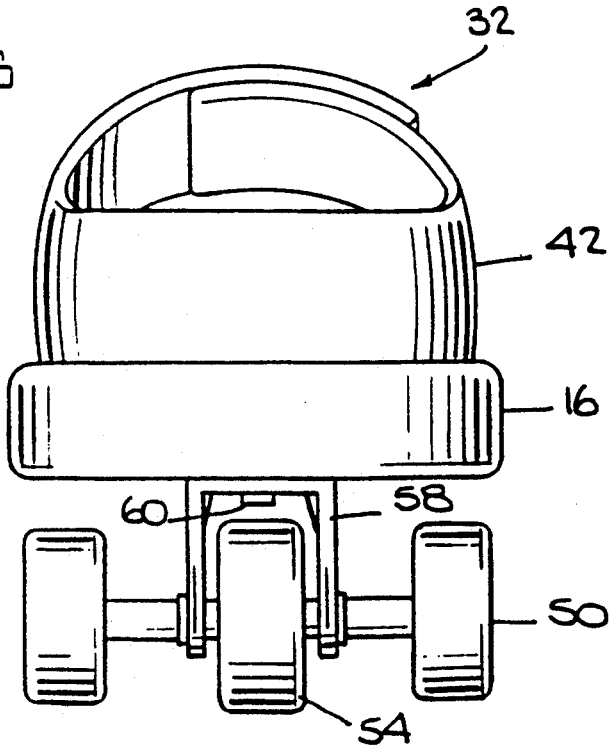

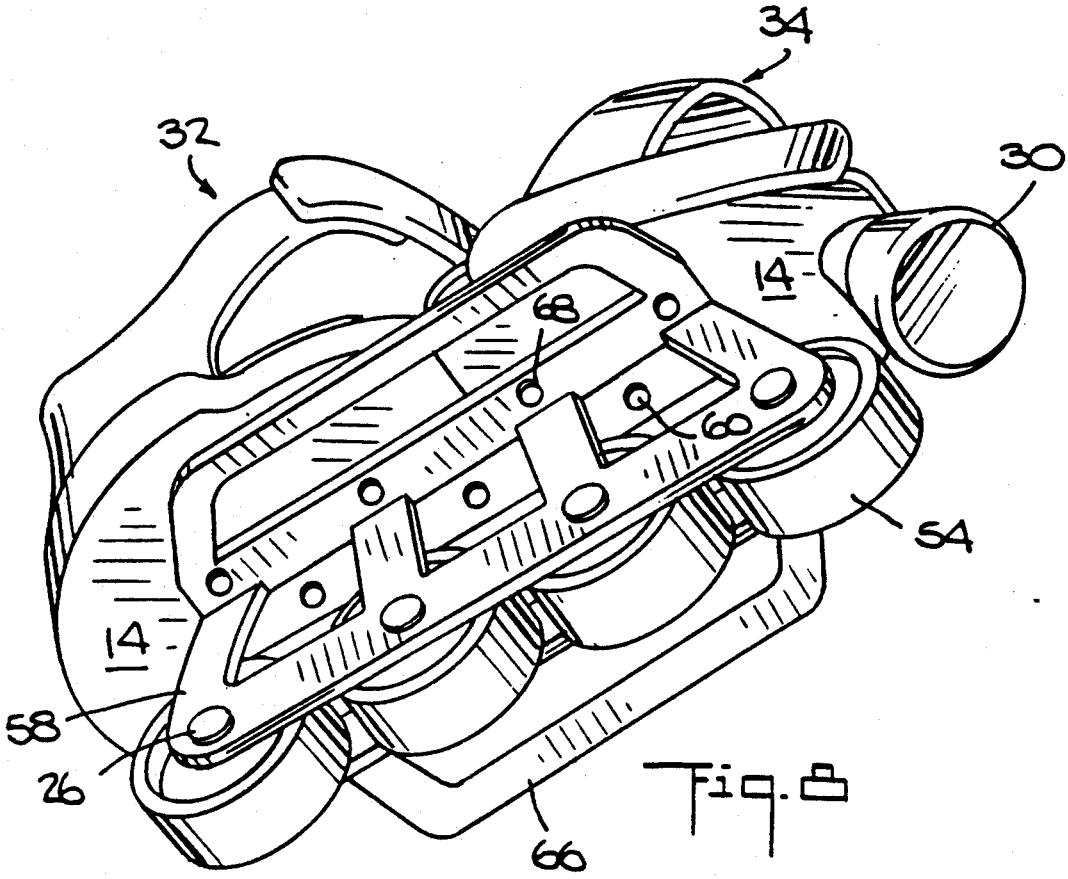
Fig. 8
Fig. 9
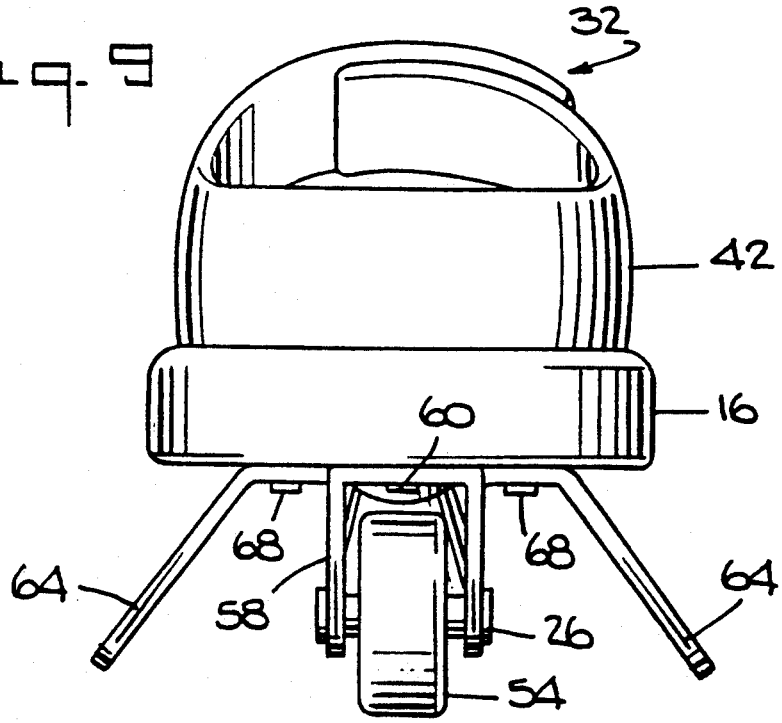

FOOT TRANSPORT DEVICE

The present invention relates to a transport device for fastening to a foot.

Transport devices such as skates and skis are difficult to learn and use.

The present invention seeks to provide a transport device which is easier to learn to use than those presently available.

According to the present invention there is provided a transport device for fastening to a foot, said transport device comprising a sole portion, and means for enabling movement of the transport device over the ground, said sole portion being supported on said movement enabling means, and wherein said transport device further comprises at least one pair of stablizer members arranged one on either side of said movement enabling means.

The stabilizer members arranged on either side of the movement enabling means provide additional stability to the transport device, and thereby make the device easier for the unskilled to learn and use.

In one embodiment, the movement enabling means is an elongate runner. The transport device would, in this case, generally be referred to as a ski or ski-ing device. However, the ski may or may not be substantially conventional. For example, if it is required to move over grasslands, the runner may be kept relatively short as compared to the traditional length of the runners of skis for snow.

In an alternative embodiment, the movement enabling means is an elongate blade. In this case, the transport device would be referred to as a skate or skating device.

An alternative transport device, which would also be referred to as a skate or skating device, has movement enabling means in the form or one or more wheels or rollers.

The stabilizer members are preferably supported by said sole portion and intermediate the ends thereof and on opposite sides of the movement enabling means. Additionally and/or alternatively, the stabilizer members may be connected to said movement enabling means. Preferably, the stabilizer members are removably supported. This enables the stabilizer members to be be removed, if required, when the degree of skill has been achieved.

The nature of the stabilizer members is preferably chosen to suit the terrain over which the transport device is to be used. For example, where the transport device is a ski having an elongate runner, each stabilizer member may be a skid or auxiliary runner. Where the transport device is a bladed skate, the stabilizer member might be skids or runner, or may be wheels. In the case of a roller skate, it is generally preferred that the stabilizer members are wheels. Alternatively the stabilizer members can be an outrigger blade.

In a preferred embodiment, the stabilizer members are supported to protrude laterally outwardly of said movement enabling means. Preferably, ground contact surfaces of the stabilizer members are supported to be nearer to the sole portion than ground contact surfaces of the movement enabling means. In this case, the user can use the transport device substantially conventionally, but if there is a tendency to tilt in either lateral direction, the one or the other of the stabilizer members comes into contact with the ground.

In a preferred embodiment, the stabilizer members comprise a single pair of wheels supported by the sole portion of roller skate. The stabilizer wheels may be arranged to protrude on either side of a substantially conventional roller skate having two transverse rows of wheels. However, in preferred embodiment, the roller skate is formed to have just a single column of wheels extending successively in tandem along the longitudinal extent of the sole portion. Preferably there are at least three wheels in the single column of wheels. In this case, it can be arranged for the pair of stabilizer wheels to be selectively fixed to the axis extending through any of the wheels.

The transport device may comprise means on the sole portion for attaching the device to a boot, shoe or foot. Alternatively, straps, and/or an upper may be fixed to the sole portion for receipt of the foot.

In a preferred embodiment, the sole portion comprises an elongate slide fixed either to a toe portion or a heel portion. The free end of the slide is insertable in the other of a heel portion or a toe portion and can be locked in position. By this means, the length of the sole portion can be chosen as required. In this case, where the device is a roller skate, one of the heel and toe portion is arranged to support half of the number of wheels provided, and the other of the heel and toe portion is arranged to support the other half of the number of wheels provided.

Embodiments of the present invention will hereinafter be described, by way of example, with reference to the accompanying drawings, in which:

FIG. 5 shows a perspective view of the skate of FIG. 4 as seen from underneath;

FIG. 6 shows a rear view of the skate of FIG. 4;

FIG. 8 shows a perspective view of the skate of FIG. 7 as seen from and underneath; and FIG. 9 shows a rear view of the skate of FIG. 7.

Figure 1:
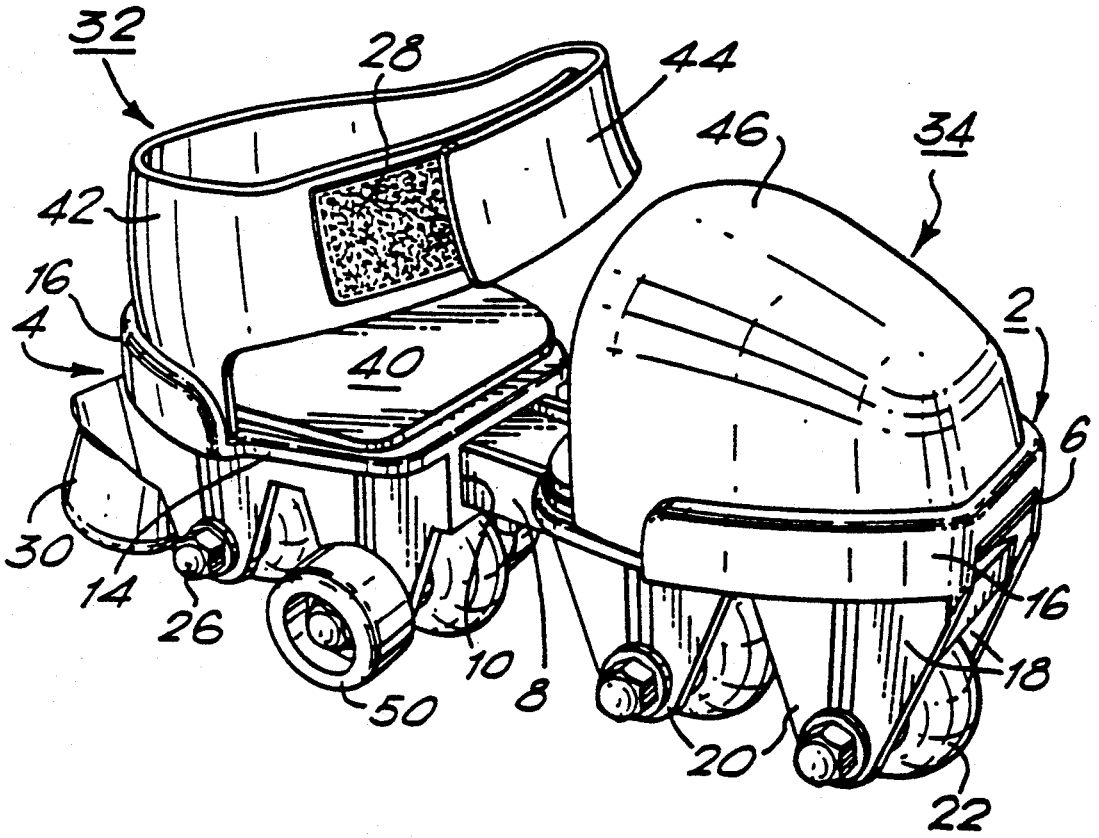
FIG. 1 shows a perspective view of a roller skate of the invention.

The drawings show embodiments of a roller skate provided with stabilizer members to enable the user to acquire skill on the roller skate. Whilst the drawings specifically show a roller skate, the invention is equally applicable to any transport device for fastening to the foot.

The skate illustrated comprises a sole portion 2. To enable the length of the skate to be adjusted to provide a good fit, the sole portion 2 comprises heel portion 4 and a toe portion 6 interconnected by way of a slide 8. In the particular embodiment shown, the slide 8 is integrally formed with the toe portion 6 and is received within a channel, indicated at 10, in the heel portion 4. Releasable engagement means 12 (FIG. 3) are arranged to fix the slide 8 in a chosen position relative to the heel portion 4 to adjust the sole portion 2 to the required length. The structure of the means 12 is not further described as any suitable engagment means may be provided.

Figure 2:
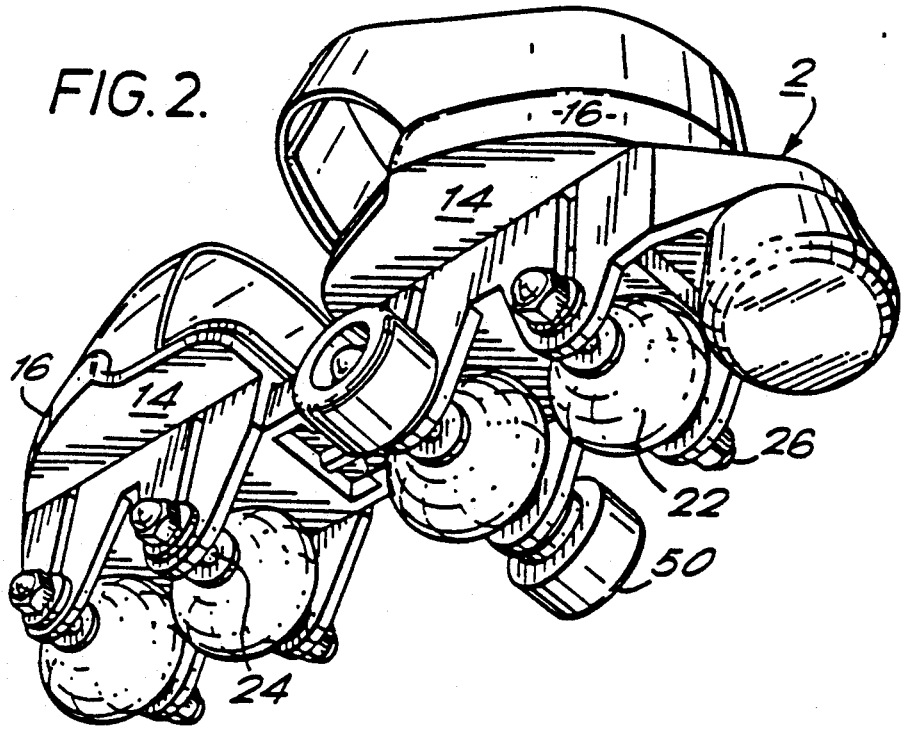
FIG. 2 shows a perspective view of the skate of FIG. 1 as seen from underneath.
Figure 3:
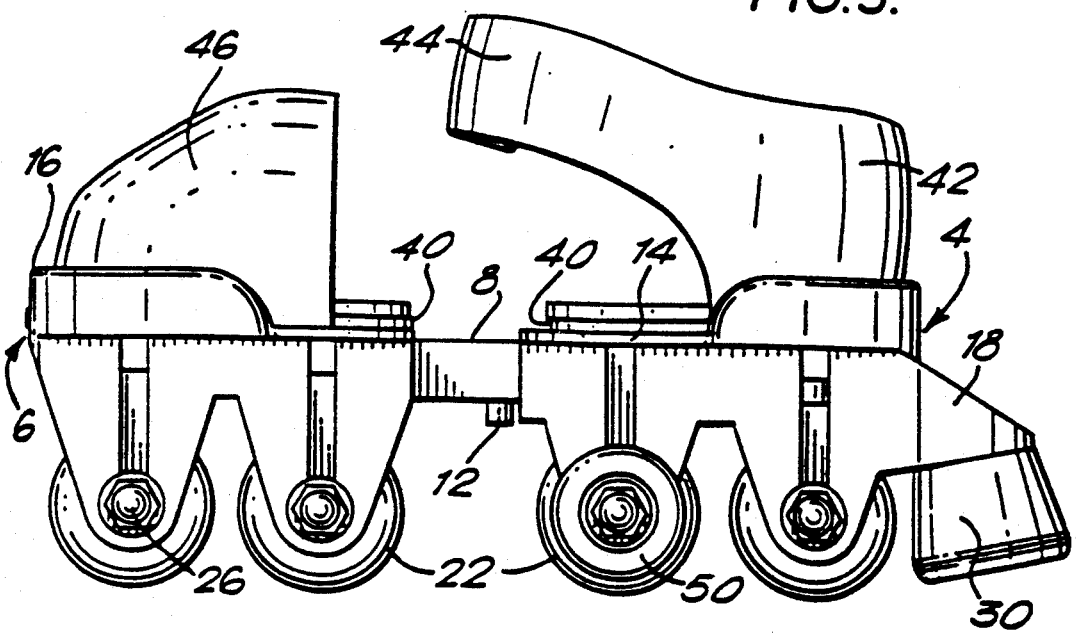
FIG. 3 shows a side elevation of the skate of FIGS. 1 and 2.

In the embodiment illustrated in FIGS. 1 to 3 the heel portion 4 comprises a substantially planar heel plate 14 having an integrally formed, upstanding rim 16 defining a heel for the skate. The plate 14 also has a pair of spaced, integrally formed, depending walls 18, which extend substantially parallel to one another on opposite sides of the plate 14. Each wall 18 is shaped to define two individual projections which are generally U-shaped in cross-section. At the base of each projection a through bore (not visible) is formed through which a shaft 24 is arranged to extend. Each shaft 24 extends through a respective wheel 22 which is thereby supported by two opposed projections 20 through the bores of which the shaft 24 extends. Nuts applied to each end of each shaft 24 hold the respective wheel 22 in position.

It will be seen that in the embodiment illustrated in FIGS. 1 to 3 two wheels 22 are mounted, one behind, the other, on the heel portion 4. The toe portion 6 has a similar construction to that of the heel portion 4, having a substantially planar toe plate 14 with an upstanding rim 16 and two spaced depending walls 18. The walls 18 of the toe portion 6 are similarly arranged to carry two wheels 22. It will be seen, therefore, that the four wheels 22 of the skate are arranged in a column extending along the length of the sole portion 2. It will also be appreciated that the wheels 22 support the sole portion 2. In a known manner, a buffer 30 is affixed to the rear of the heel portion 4.

It would of course be possible to provide clips or other engaging means on the upstanding rims 16 forming the heel and toe of the sole portion 2 for engagement with the shoe or foot of the wearer. However, in the embodiment illustrated upper portions portions, namely a heel upper 32 and a toe upper 34 are provided. In this respect, the sole portion 2 is preferably molded out a rigid plastic material. The upper portions 32 and 34, may also be made of a plastics material, but the upper portions 32, 34 are generally made of a less rigid plastics material.

The heel upper portion 32 is preferably formed to have an underheel pad, indicated at 40, which is integrally formed with an upstanding portion 42 defining an ankle strap 44. The ends of the ankle strap 44 are provided with releasable fastening means 28, which may be of any suitable type, but which in the embodiment illustrated comprise a fastening made of Velcro (Registered Trade Mark). The toe upper portion 34 similarly includes an undertoe pad which is mounted on the toe portion 6 and which is integrally formed with a front upper portion 46. The pads of the upper portions 32 and 34 are each fastened to the respective heel portion 4 and toe portion 6, for example, by way of screws, gluing and the like.

The shaft 24 carrying one of the wheels 22 carries a pair of spaced stabilizer wheels 50 which are fixed one on each end of the shaft. Thus, the stabilizer wheels 50 are spaced one on each side of the column of wheels 22. The diameter of each stabilizer wheel 50 is considerably smaller than that of each wheel 22. This means that if the skate is balanced with the periphery of each wheel 22 in contact with the ground, the peripheries of the two stabilizer wheels 50 will be clear of the ground. However, if there is any tilting of the skate laterally, a respective one of the stabilizer wheels 50 come into contact with the ground and prevent any further tilting.

In the embodiments illustrated in FIGS. 1 to 3, the, stabilizer wheels 50 are mounted on that shaft 24 which supports the front of the wheels connected to the heel portion: However, the stabilizer wheels could be supported on any of the shafts 24. If required, more than one pair of stabilizer wheels could also be provided.

In the embodiments illustrated, the stabilizer in FIGS. 1 to 3 wheels 50 protrude laterally with respect to the ground contact surfaces defined by the peripheries of the four wheels 22. However, the stabilizer wheels 50 do not protrude laterally of the sole portion 2. Of course, it would be possible, if required to provide greater stability, to arrange for the stabilizer wheels 50 to project laterally beyond the sole portion 2. For example, the shaft 24 carrying the stabilizer wheels 50 could be made longer, and the stabilizer wheels 50 could be secured to its spaced ends. Additionally and/or alternatively, the axial width of each of the stabilizer wheels may be increased to laterally protrude to the sole portion 2.

In the embodiments shown in FIGS. 1 to 3 the stabilizer wheels are removably attached to the shaft 24 by fasteners 52. As shown in FIGS. 1 to 3 the wheels have a curved exterior ground contact surface such that the cross-section of the wheels 22 is substantially rounded.

In the embodiments of FIGS. 4 to 9, structural features common to the embodiment shown in FIGS. 1 to 3 are designated with like reference numerals.

Figure 4:
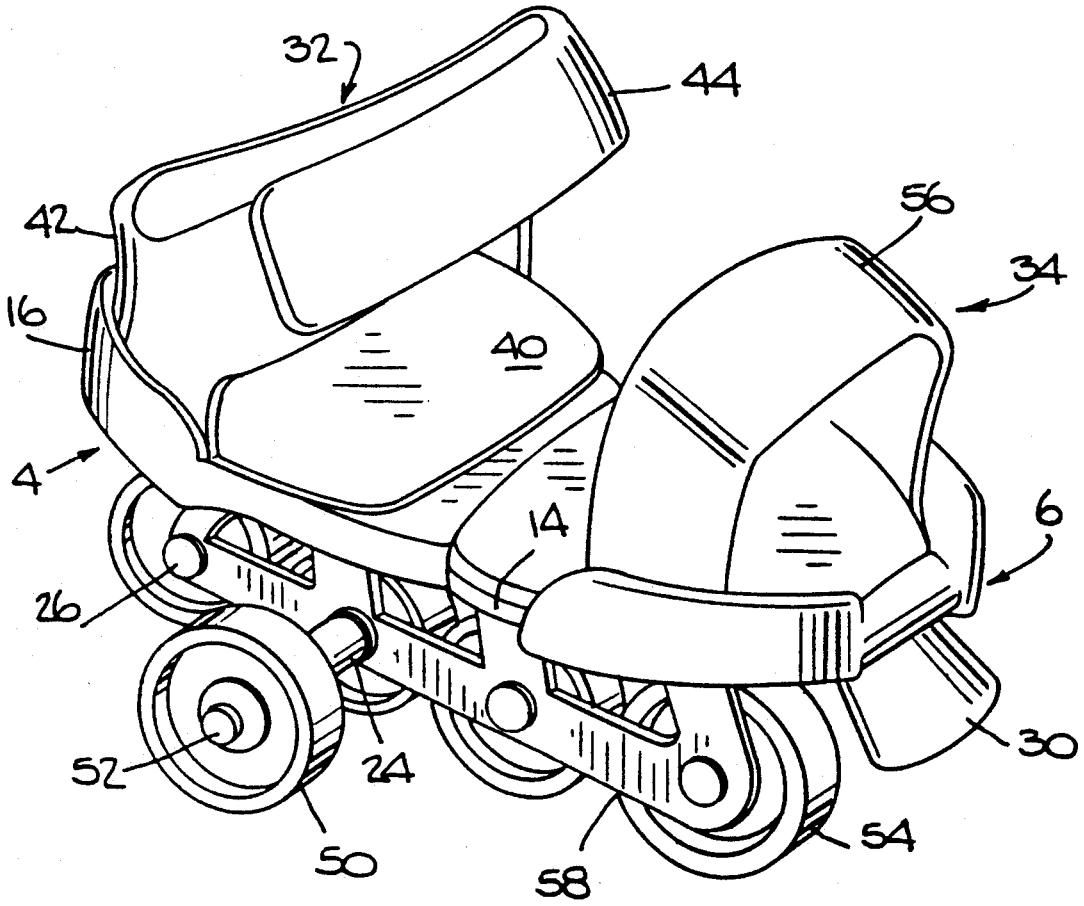
FIG. 4 shows a perspective view of another embodiment of a roller skate of the invention.

In the embodiment of FIGS. 4 to 6 the movement enabling means comprises wheels 54 which have a substantially defined edge exterior ground contact such that the cross-section of wheels 54 is substanially rectangular. Of course, the cross-section of the wheels comprising the movement enabling means may be either substanially rectangular or substantially rounded.

In the embodiment illustrated in FIGS. 4 to 9 the toe upper 34 may be a strap 56 or the like instead of the closed front upper portion 46 as shown in FIGS. 1 to 3. Alternatively, the embodiments of FIGS. 1 to 9 may have either the closed front upper portion or a strap. The strap may have releasably fastening means similar to means 28. In the embodiments shown in FIGS. 4 to 9 wheel support 58 affixes the wheels 54 to, for example, the sole portion by by fastening means 60.

In the embodiments shown in FIGS. 1 to 9 the stabilizer wheels 50 are more adjacent to one end than the other end of the sole portion 2. In the embodiments of FIGS. 1 to 9 the buffer 30 is disposed adjacent one end of the sole means and, in particular, in FIGS. 1 to 3 the buffer is adjacent the same end of the sole means as the stabilizer wheels and in FIGS. 4 to 9 the buffer is more adjacent the other end of the sole means.

Figure 7:
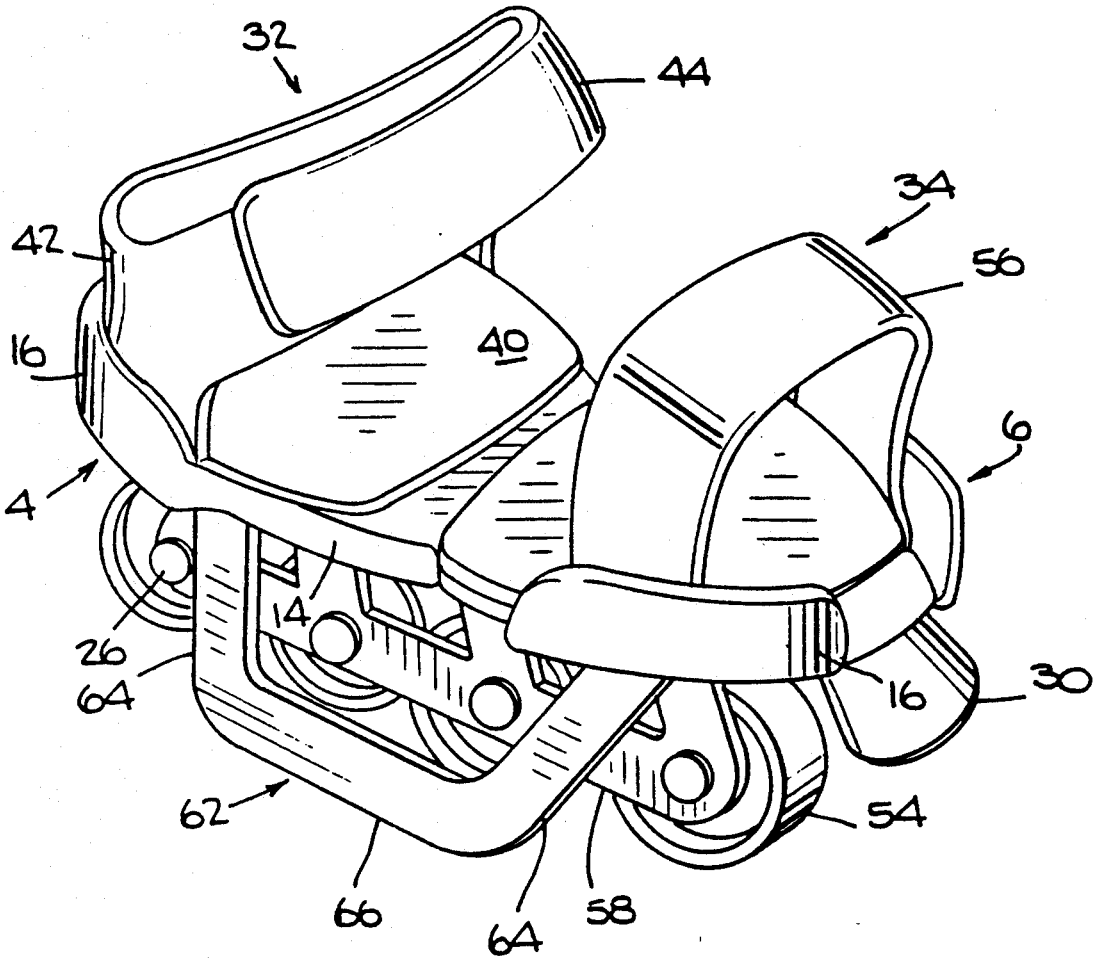
FIG. 7 shows a perspective view of a further embodiment of a roller skate of the invention.

In the embodiment of FIGS. 7 to 9 the stabilizer means comprises an outrigger blade 62 having legs 64 and a connecting member 66. The blade 62 is affixed, for example, to the sole portion by removable fastening means 68. The blade 62 is oriented at an acute angle with respect to the sole means 2. In a manner similar to the stabilizer wheels 50 of the embodiments shown in FIGS. 1 to 6, the blade 62 may protrude laterally of the movement enabling means and have a ground contact surface nearer to the sole means than the ground contact surface of the movement enabling means. Alternatively, the blade 62 and support 58 may also be an integral member.

Adjustment of the length of the embodiments of FIGS. 4 to 9 may be in a manner similar to the slide 8, channel 10, and engagement means 12 of FIGS. 1 to 3 such that the planar heel plate 14 is stationary and only the pad 40 is movable. Alternatively, wheel support 58 may be separable into two parts and the slide 8 and channel 10 may permit both the plate 14 and the pad 40 to also be separable. Of course, in this arrangement it may also be necessary to allow the separation of the blade 62 into two parts. Alternatively, the wheel support 58 or the blade 62 may be formed by telescoping sections 30 thereby avoiding separation into two parts.

It will be appreciated that variations in, and modifications to the invention may be made within the scope of this application.

What is claimed is:

1. A foot transport device to be fastened to a foot comprising:

sole means for fastening to the foot and supporting movement enabling means;

the movement enabling means comprising at least three roller means arranged successively in tandem in a single column for substantially the entire longitudinal extent of the sole means, wherein the movement enabling means is in ground contact for substantially the entire column of the longitudinal extent of the sole means; and stabilizer means arranged intermediate the ends of the sole means and the movement enabling means, the stabilizing means comprising wheels that are smaller than the at least three roller means which are disposed laterally outwardly of and on opposite sides of and in coaxial alignment with one of the roller means of the movement enabling means.

2. The foot transport device of claim 1 wherein stabilizer means is removable.

3. The foot transport device of claim 1 wherein the device is adjustable in length.

4. The foot transport device of claim 1 wherein the stabilizer means is more adjacent one end of the sole means than another end.

5. The foot transport device of claim 1 wherein a buffer is disposed adjacent one end of the sole means.

6. The foot transport device of claim 1 wherein the roller means has a substantially rounded cross-section.

7. The foot transport device of claim 1 wherein the roller means has a substantially rectangular cross-section.

8. The foot transport device of claim 1 or 2 or 3 or 4 or 5 or 6 or 7 wherein ground contact surfaces of the stabilizer means are supported to be nearer to the sole means than ground contact surfaces of the movement enabling means.

* * * * *